US009255428B1

(12) United States Patent
Shiu et al.

(10) Patent No.: US 9,255,428 B1
(45) Date of Patent: Feb. 9, 2016

(54) METHOD FOR INSPECTING LOCK SET

(71) Applicant: TAIWAN FU HSING INDUSTRIAL CO., LTD., Kaohsiung (TW)

(72) Inventors: Jiun-Nan Shiu, Kaohsiung (TW); Shih-Min Lu, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 14/566,746

(22) Filed: Dec. 11, 2014

(30) Foreign Application Priority Data

Aug. 14, 2014 (TW) ..... 103127883 A

(51) Int. Cl.
*E05B 41/00* (2006.01)
*E05B 47/00* (2006.01)

(52) U.S. Cl.
CPC ..... *E05B 47/0001* (2013.01); *E05B 2047/0067* (2013.01); *E05B 2047/0068* (2013.01); *E05B 2047/0069* (2013.01); *Y10S 70/59* (2013.01); *Y10T 70/7949* (2015.04); *Y10T 70/8027* (2015.04); *Y10T 70/827* (2015.04)

(58) Field of Classification Search
CPC ..... E05B 47/0001; E05B 2047/0067; E05B 2047/0068; E05B 2047/0069; E05B 2047/0048; Y10T 70/8027; Y10T 70/827; Y10T 70/7949; Y10S 70/59
USPC ..... 70/1.5, 1.7, 278.7, 417, 422, 432–434, 70/441, DIG. 59; 340/542
See application file for complete search history.

(56) References Cited

U.S. PATENT DOCUMENTS 4,685,709 A * 8/1987 Kambic ..... E05B 47/0012 292/201
4,912,456 A * 3/1990 Mickel ..... G08B 13/06 200/61.67
5,062,670 A * 11/1991 Grossman ..... E05B 45/083 200/61.64
2005/0225097 A1* 10/2005 Geringer ..... E05B 47/0657 292/144
2008/0236214 A1* 10/2008 Han ..... E05B 47/0012 70/129

* cited by examiner

*Primary Examiner* — Lloyd Gall
(74) *Attorney, Agent, or Firm* — Jackson IPG PLLC; Demian K. Jackson

(57) ABSTRACT

A method for inspecting a lock set is to utilize a reception unit for receiving the signals from a lock set mounted at a door to inspect whether the door is closed and whether the lock set is locked or being broken.

10 Claims, 6 Drawing Sheets

METHOD FOR INSPECTING LOCK SET

FIELD OF THE INVENTION

The present invention relates to a method for inspecting a lock set. Particularly presenting the method for inspecting whether a door is closed, the lock set is locked or the lock set is damaged.

BACKGROUND OF THE INVENTION

In conventional prior art, a lock set is mounted at a door and a latch of the lock set is inserted in a door frame to keep the door from being opened and provide burglarproof function. However, someone enables open the door and invade into the room when the door frame or the latch is broken for purpose. The user can not learn that the lock set is damaged or the door is opened.

SUMMARY

The primary object of the present invention is to provide a method for inspecting a lock set. The method includes providing a lock set and a reception unit, wherein the lock set mounted at a door comprises a driving member, a latch, a first electronic switch and a second electronic switch. The first electronic switch is used for sensing whether the driving member operates or not and transmitting a first signal or a second signal. The second electronic switch is used for sensing whether the latch operates or not and transmitting a third signal or a fourth signal. The signals from the first electronic switch and the second electronic switch are received by the reception unit. The reception unit determines that the latch is broken and the door is opened when the signals received by the reception unit are changed from the second signal and the fourth signal to the first signal and the fourth signal.

In the present invention, the reception unit receives the signals from the lock set for inspecting whether the door is closed and whether the lock set is locked to prevent the user from misjudging the door is closed or the lock set is locked. Additionally, the reception unit enables to determine whether the locked lock set is being broken by the signal from the lock set to improve the burglarproof and warning functions.

DETAILED DESCRIPTION OF THE INVENTION

Figure 1:
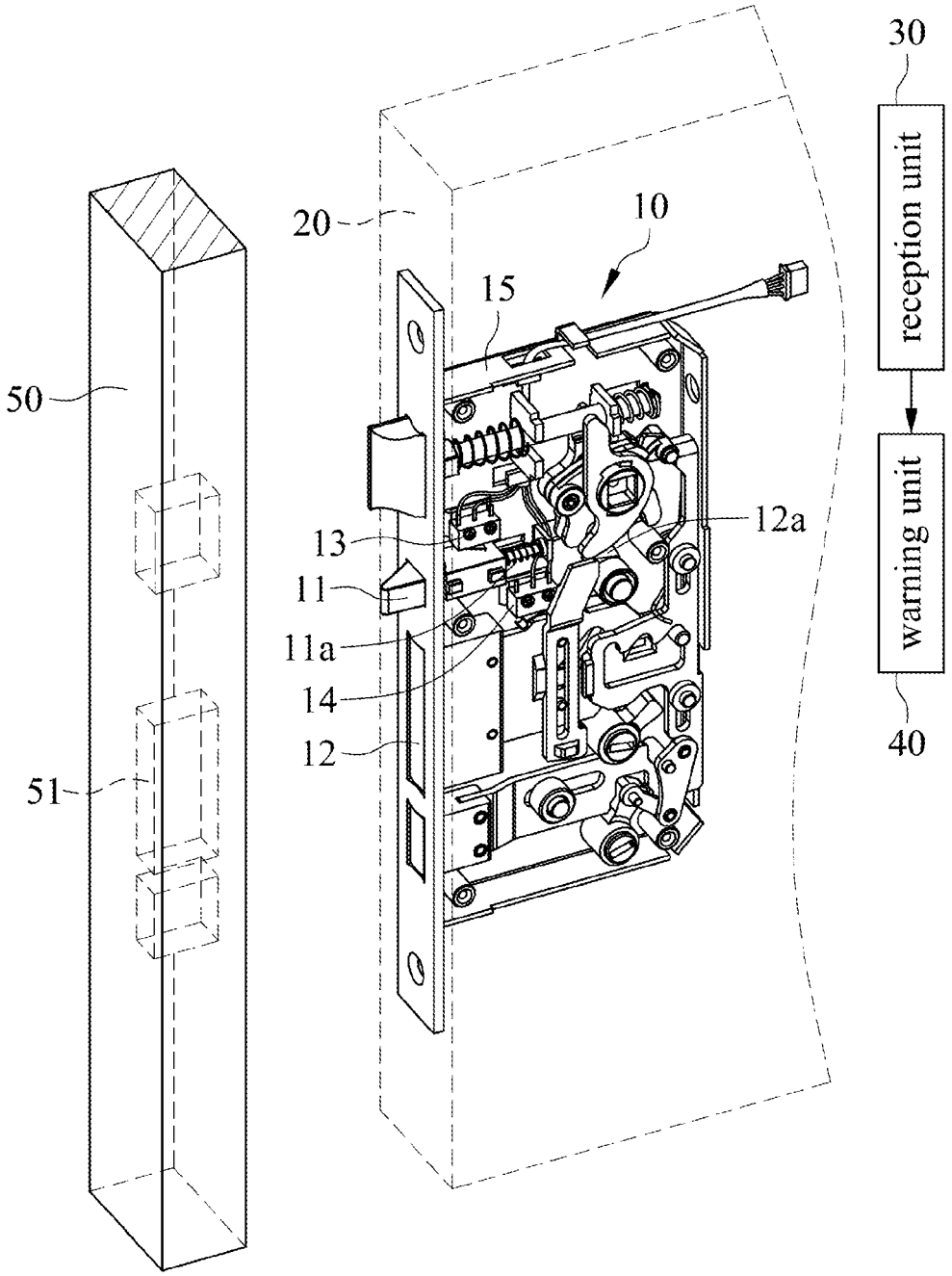
FIG. 1 is a perspective diagram illustrating a lock set mounted at a door plate in accordance with the present invention.

With reference to FIG. 1, a method for inspecting a lock set is illustrated in accordance with an embodiment of the present invention. First, providing a lock set inspection system including a lock set 10 and a reception unit 30, wherein the lock set 10 is mounted at a door 20 and the reception unit 30 is used for receiving the signals from the lock set 10. In this embodiment, a lateral side of the door 20 is pivotally disposed at a door frame 50 for making the door 20 being opened or closed, and the lock set 10 is mounted at the other lateral side of the door 20, wherein the door frame 50 comprises a limiting hole 51.

Figure 2:
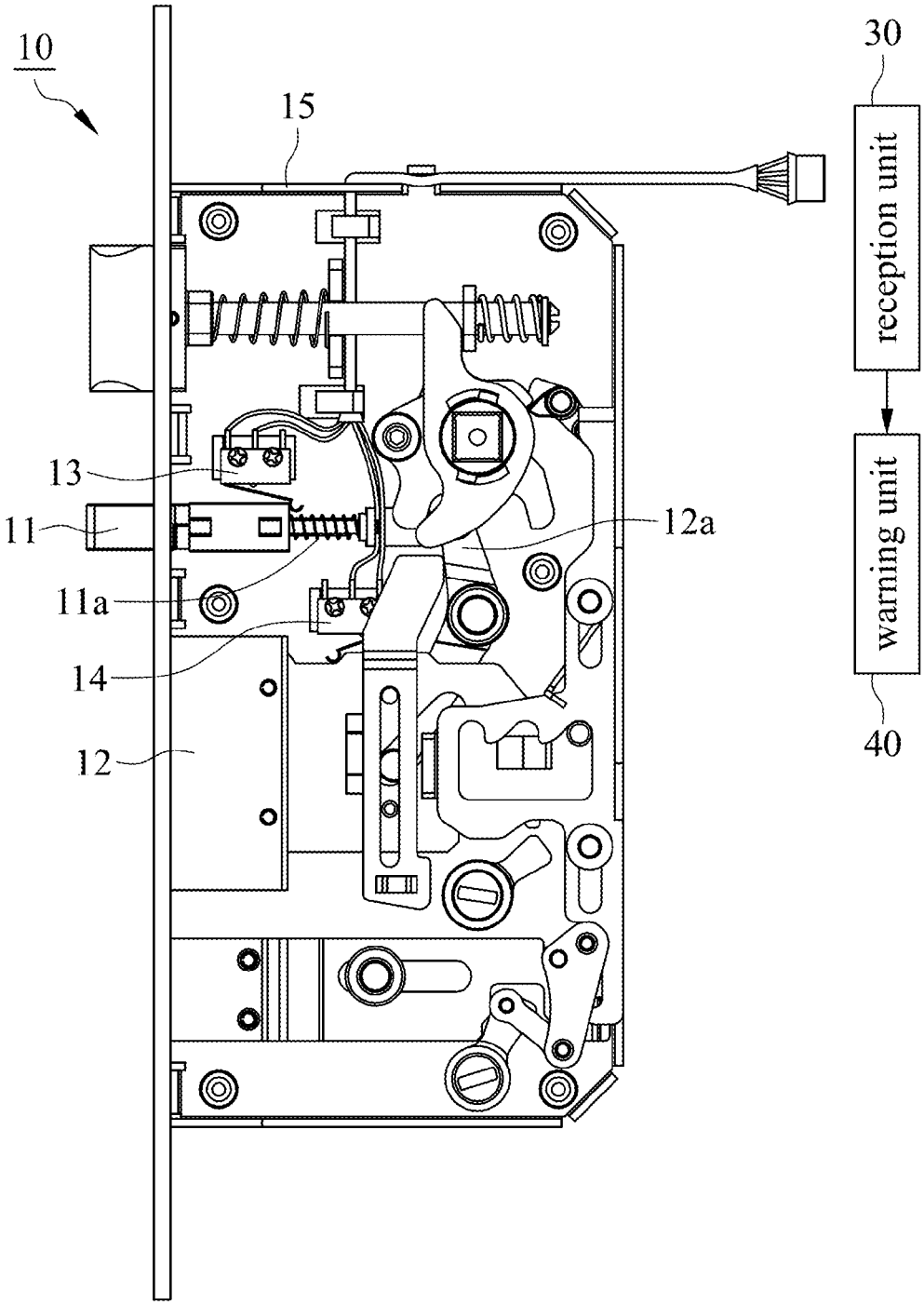
FIGS. 2 to 5 are diagrams illustrating actions of a driving member and a latch of the lock set in accordance with the present invention.

With reference to FIGS. 1 and 2, the lock set 10 comprises a driving member 11, a latch 12, a first electronic switch 13, a second electronic switch 14 and a case 15. In this embodiment, the driving member 11 and the latch 12 are disposed within the case 15. The driving member 11 is pushed by an elastic member 11*a* to protrude to the case 15 when the door 20 is opened. Relatively, the driving member 11 is pushed by the door frame 50 to hide into the case 15 when the door 20 is closed. The first electronic switch 13 is used for sensing whether the driving member 11 operates or not and transmitting a first signal S1 or a second signal S2. In this embodiment, the first signal S1 is the signal indicates the driving member 11 protrudes to the case 15, which represents the door 20 is opened, and the second signal S2 is the signal indicates the driving member 11 hides into the case 15, which represents the door 20 is closed.

Figure 3:
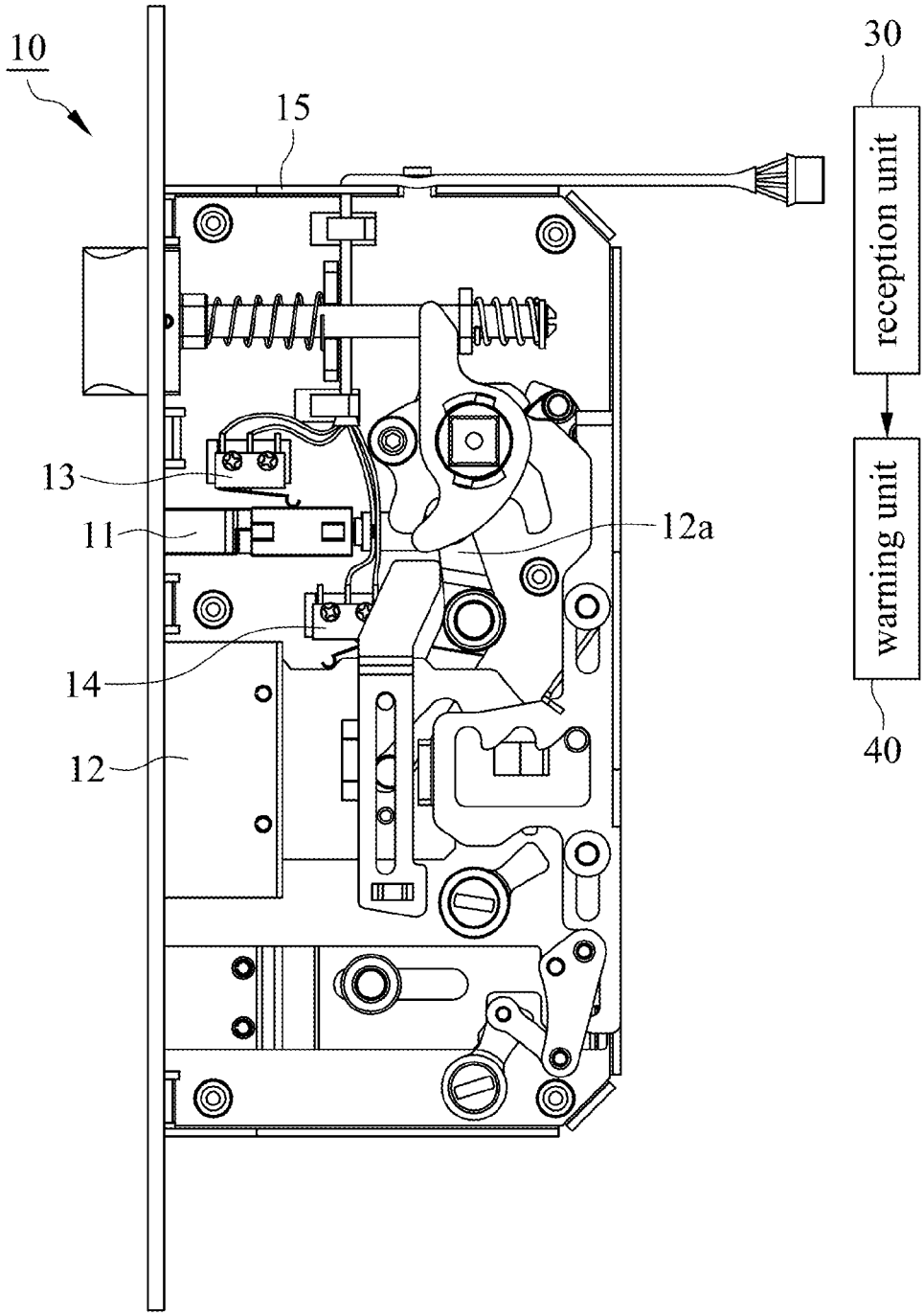

With reference to FIGS. 1, 2 and 3, the latch 12 is driven by a linking member 12*a* to optionally protrude to the case 15 or hide into the case 15. The second electronic switch 14 is used for sensing whether the latch 12 operates or not and transmitting a third signal S3 or a fourth signal S4. In this embodiment, the latch 12 corresponds to the limiting hole 51 of the door frame 50 and enables to be driven by the linking member 12*a* to insert into the limiting hole 51 for keeping the door 20 from being opened when the door 20 is closed. Relatively, the door 20 enables to be opened when the latch 12 is driven by the linking member 12*a* to depart from the limiting hole 51. In this embodiment, the third signal S3 is the signal indicates the latch 12 hides into the case 15, and the fourth signal S4 is the signal indicates the latch 12 protrudes to the case 15.

Figure 6:
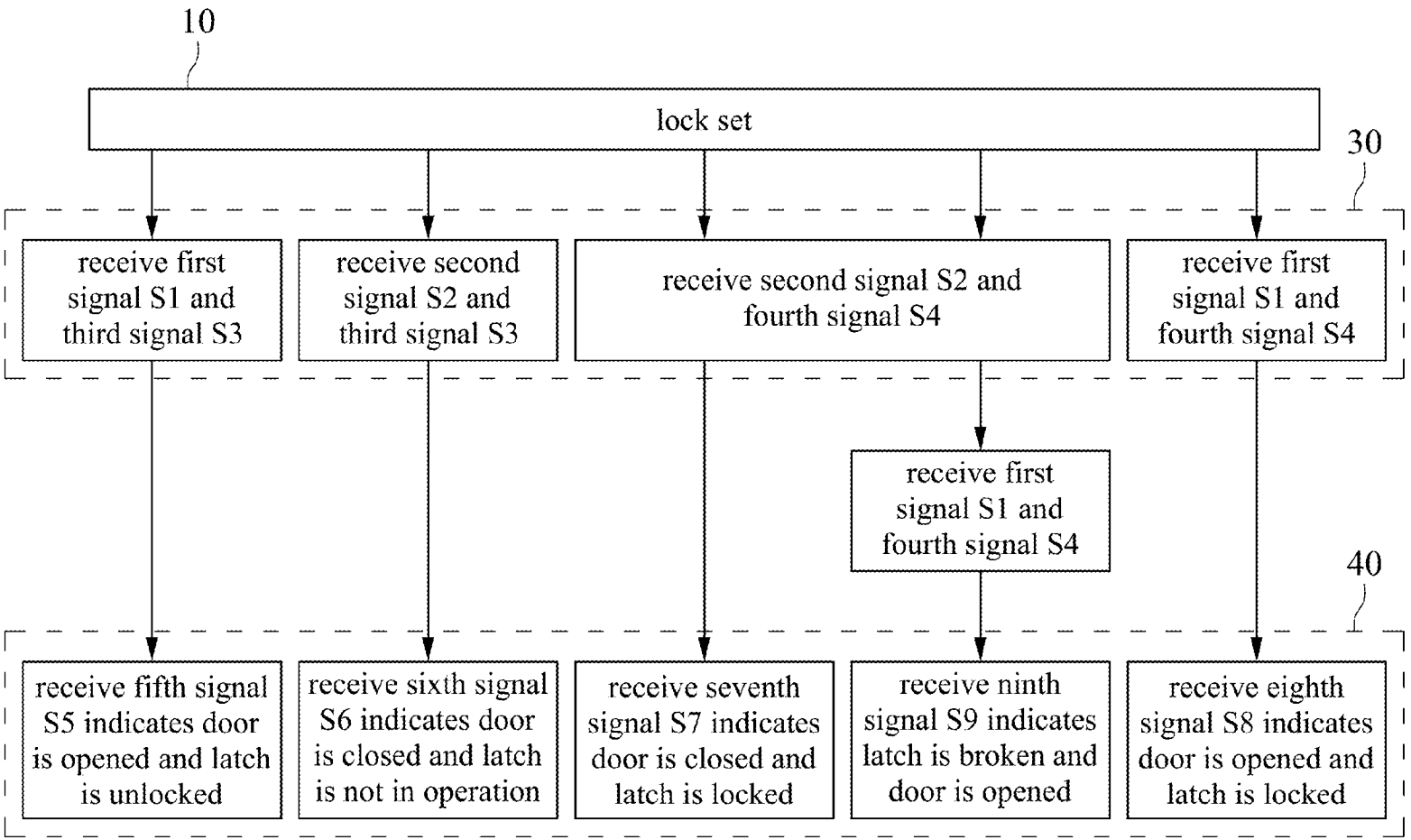
FIG. 6 is a flow chart illustrating a method for inspecting the lock set in accordance with the present invention.

With reference to FIGS. 1 and 6, in this embodiment, the first electronic switch 13 transmits the first signal S1 representing the door 20 is opened when the driving member 11 is pushed by the elastic member 11*a* to protrude to the case 15. Relatively, the first electronic switch 13 is actuated by the driving member 11 to transmit the second signal S2 representing the door 20 is closed when the driving member 11 is pushed by the door frame 50 to hide into the case 15, wherein the first electronic switch 13 is selected from micro switch or sensor.

With reference to FIGS. 1 and 6, in this embodiment, the second electronic switch 14 is actuated by the latch 12 to transmit the third signal S3 when the latch 12 is driven by the linking member 12*a* to hide into the case 15. Relatively, the second electronic switch 14 is actuated by the latch 12 to transmit the fourth signal S4 when the latch 12 is driven by the linking member 12*a* to protrude to the case 15, wherein the second electronic switch 14 is selected from micro switch or sensor.

With reference to FIG. 1, providing the reception unit 30 used for receiving the first signal S1 or the second signal S2 transmitted from the first electronic switch 13 and receiving the third signal S3 or the fourth signal S4 transmitted from the second electronic switch 14.

With reference to FIG. 6, the inspection method of the present invention can inspect at least five possible states to assist the user in determining whether the lock set 10 and the door 20 operate in normal state or not.

First, referring to FIGS. 1, 2 and 6, FIG. 2 is a first inspection state. The reception unit 30 determines that the door 20 is opened and the latch 12 is unlocked (the state represents the latch 12 hides into the case 15) when the reception unit 30 receives the first signal S1 and the third signal S3. That means, the first electronic switch 13 generates the first signal S1 when the driving member 11 is not in operation and not drive the first electronic switch 13, and the second electronic switch 14 generates the third signal S3 when the latch 12 is not in operation and not drive the second electronic switch 14, wherein the first signal S1 and the third signal S3 are transmitted to the reception unit 30. In this embodiment, after receiving the first signal S1 and the third signal S3 by the reception unit 30, the reception unit 30 transmits a signal S5 indicates that a door is opened and a latch is unlocked. The signal S5 indicates a door is opened and a latch is unlocked is received by a warning unit 40 to inform the user that the door 20 is opened and the latch 12 is unlocked, wherein the warning unit 40 is selected from monitor, warning light, speaker or buzzer.

With reference to FIGS. 1, 3 and 6, FIG. 3 is a second inspection state. The reception unit 30 determines that the door 20 is closed and the latch 12 is unlocked (the state represents the latch 12 hides into the case 15) when the reception unit 30 receives the second signal S2 and the third signal S3. That means, the first electronic switch 13 is actuated by the driving member 11 to generate the second signal S2 when the driving member 11 is pushed by the door frame 50 to hide into the case 15, and the second electronic switch 14 generates the third signal S3 when the latch 12 is not in operation and not drive the second electronic switch 14, wherein the second signal S2 and the third signal S3 are transmitted to the reception unit 30. In this embodiment, after receiving the second signal S2 and the third signal S3 by the reception unit 30, the reception unit 30 transmits a signal S6 indicates that a door is closed and a latch is not in operation. The signal S6 indicates a door is closed and a latch is not in operation is received by the warning unit 40 to inform the user that the door 20 is closed and the latch 12 is unlocked.

Figure 4:
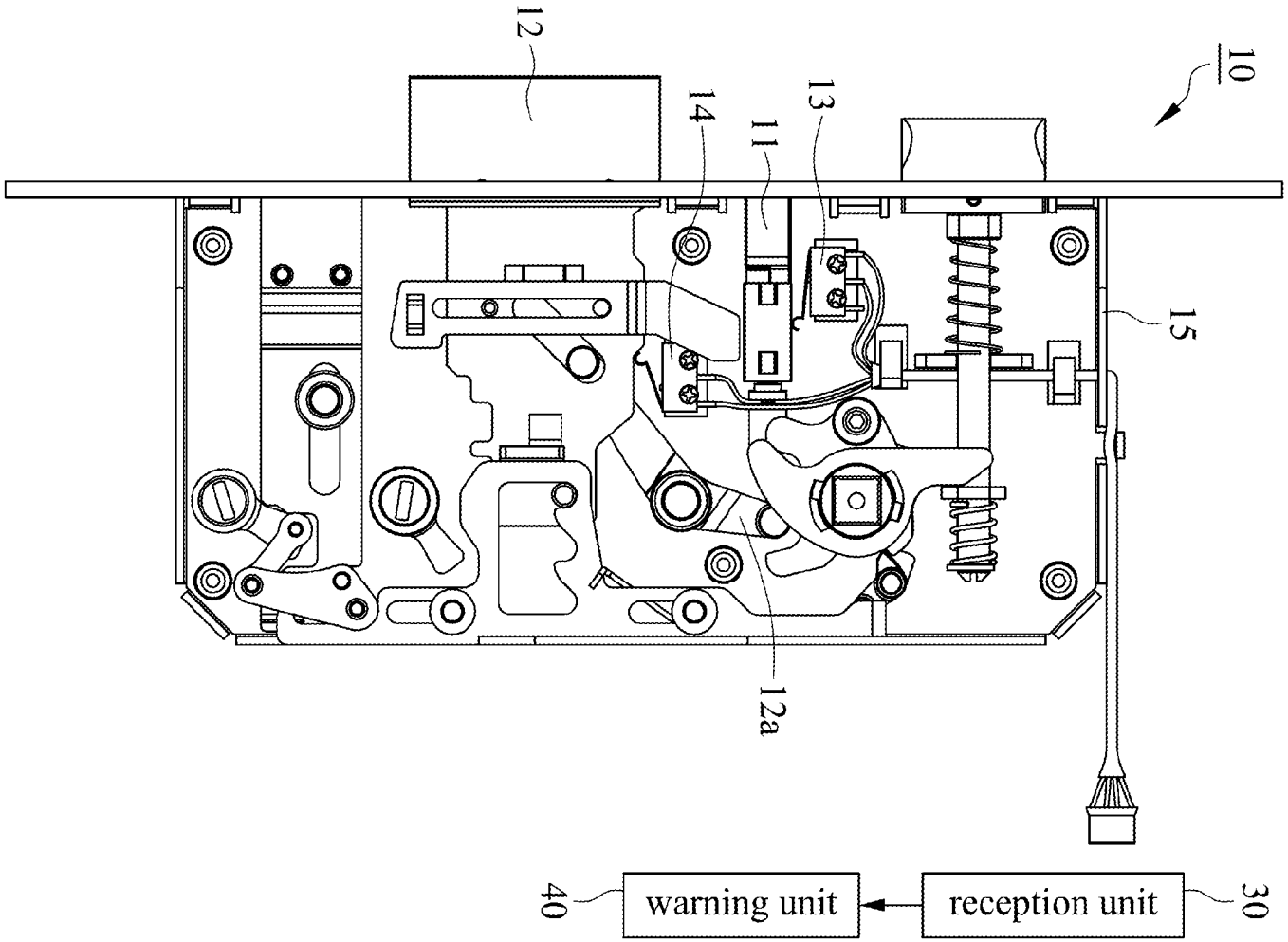

With reference to FIGS. 1, 4 and 6, FIG. 4 is a third inspection state. The reception unit 30 determines that the door 20 is closed and the latch 12 is locked (the state represents the latch 12 protrudes to the case 15) when the reception unit 30 receives the second signal S2 and the fourth signal S4. That means, the first electronic switch 13 is actuated by the driving member 11 to generate the second signal S2 when the driving member 11 is pushed by the door frame 50 to hide into the case 15, and the second electronic switch 14 is actuated by the latch 12 protrudes to the case 15 to generate the fourth signal S4 when the linking member 12*a* drives the latch 12, wherein the second signal S2 and the fourth signal S4 are transmitted to the reception unit 30. In this embodiment, after receiving the second signal S2 and the fourth signal S4 by the reception unit 30, the reception unit 30 transmits a signal S7 indicates that a door is closed and a latch is locked. The signal S7 indicates a door is closed and a latch is locked is received by the warning unit 40 to inform the user that the door 20 is closed and the latch 12 is locked.

Figure 5:
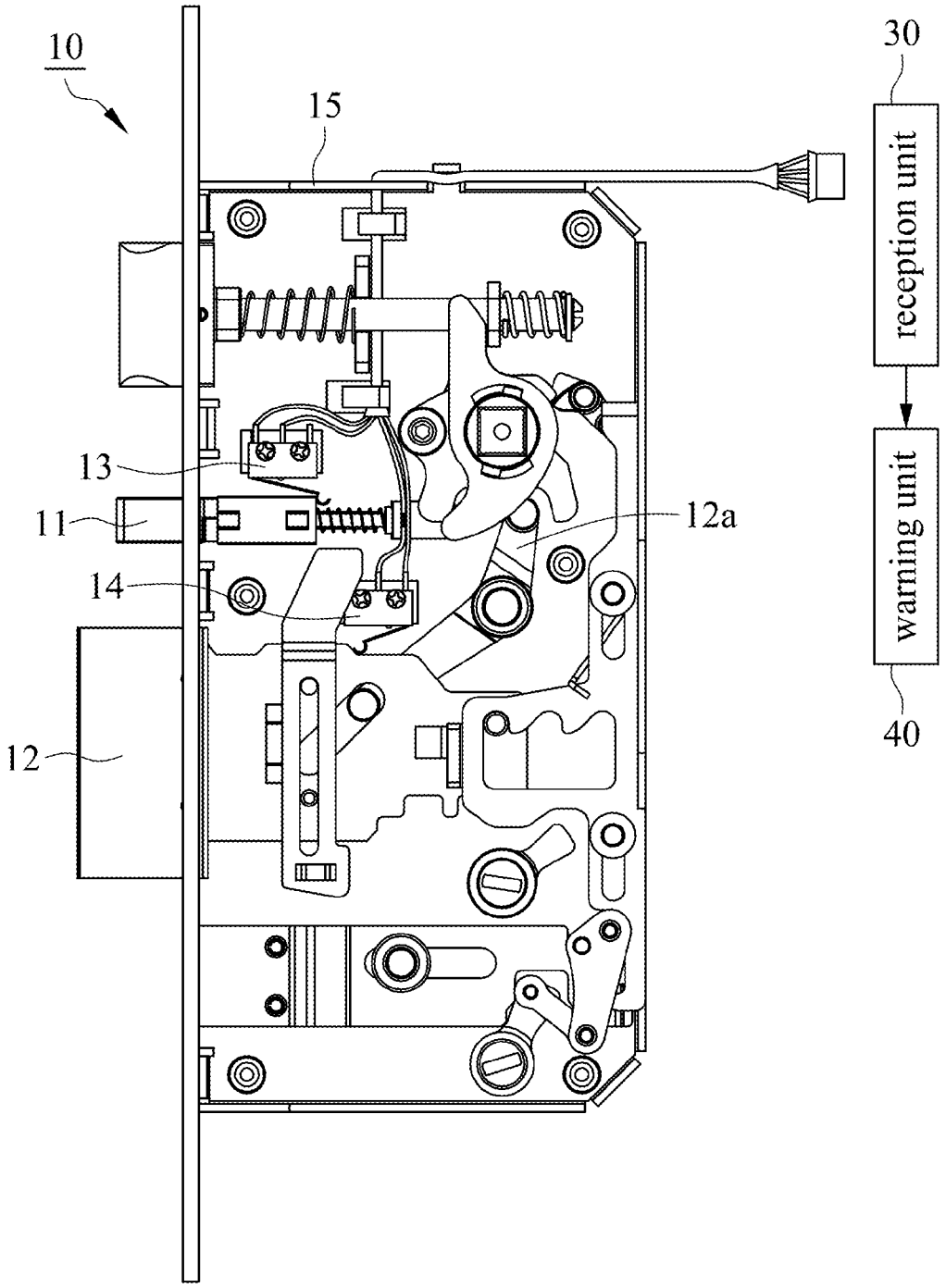

With reference to FIGS. 1, 5 and 6, FIG. 5 is a fourth inspection state. The reception unit 30 determines that the door 20 is opened and the latch 12 is locked (the state represents the latch 12 protrudes to the case 15) when the reception unit 30 receives the first signal S1 and the fourth signal S4. That means, the first electronic switch 13 is not driven by the driving member 11 without operation and generates the first signal S1 when the driving member 11 is not pushed by the door frame 50 and keeps protrusion to the case 15, and the second electronic switch 14 is driven by the latch 12 and generates the fourth signal S4 when the latch 12 is driven by the linking member 12*a* to protrude to the case 15, wherein the first signal S1 and the fourth signal S4 are transmitted to the reception unit 30. In this embodiment, after receiving the first signal S1 and the fourth signal S4 by the reception unit 30, the reception unit 30 transmits a signal S8 indicates that a door is opened and a latch is locked. The signal S8 indicates a door is opened and a latch is locked is received by the warning unit 40 to inform the user that the door 20 is opened and the latch 12 is locked.

With reference to FIGS. 1, 4, 5 and 6, a fifth inspection state is illustrated. FIG. 4 shows that the door 20 is closed and the latch 12 is locked (the state represents the latch 12 protrudes to the case 15) then the reception unit 30 receives the second signal S2 and the fourth signal S4. However, when the latch 12 of the lock set 10 is broken and departs from the limiting hole 51 to make the door 20 opened, the driving member 11 is in the state protruding to the case 15 as illustrated in FIG. 5. The first electronic switch 13 is driven by the driving member 11 to generate the first signal S1, wherein the reception signal 30 receives the first signal S1 and the fourth signal S4. Therefore, the reception unit 30 determines that the latch 12 is broken and the door 20 is opened when the signals received by the reception unit 30 are changed from the second signal S2 and the fourth signal S4 to the first signal S1 and the fourth signal S4. In this embodiment, after the signals received by the reception unit 30 are changes from the second signal S2 and the fourth signal S4 to the first signal S1 and the fourth signal S4, the reception signal 30 transmits a signal S9 that indicates a latch is broken and a door is opened. The signal S9 indicates a latch is broken and a door is opened is received by the warning unit 40 to inform the user that the latch 12 is broken and the door 20 is opened.

By the method for inspecting the lock set of the present invention, the user can learn opened state or closed state of the door 20 and locked state, unlocked state or damaged state of the latch 12 to provide the burglarproof function.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A method for inspecting a lock set includes:

providing a lock set mounted at a door, wherein the lock set comprises a driving member, a latch, a first electronic switch and a second electronic switch, the first electronic switch is used for sensing whether the driving member operates or not and transmitting a first signal or a second signal, the second electronic switch is used for sensing whether the latch operates or not and transmitting a third signal or a fourth signal; and providing a reception unit for receiving the signals from the first electronic switch and the second electronic switch, wherein the reception unit determines that the latch is broken and the door is opened when the signals received by the reception unit are changed from the second signal and the fourth signal to the first signal and the fourth signal.

2. The method for inspecting a lock set in accordance with claim 1, wherein the first electronic switch generates the first signal when the driving member is not in operation and the first electronic switch is not actuated by the driving member, and the first electronic switch generates the second signal when the driving member operates and actuates the first electronic switch.

3. The method for inspecting a lock set in accordance with claim 1, wherein the second electronic switch generates the third signal when the latch is not in operation and the second electronic switch is not actuated by the latch, and the second electronic switch generates the fourth signal when the latch is in operation and actuates the second electronic switch.

4. The method for inspecting a lock set in accordance with claim 1 further includes a warning unit used for receiving the signals represents the states of the driving member and the latch.

5. The method for inspecting a lock set in accordance with claim 1, wherein the reception unit determines the door is opened and the latch is unlocked when the reception unit receives the first signal and the third signal.

6. The method for inspecting a lock set in accordance with claim 1, wherein the reception unit determines the door is closed and the latch is unlocked when the reception unit receives the second signal and the third signal.

7. The method for inspecting a lock set in accordance with claim 1, wherein the reception unit determines the door is closed and the latch is locked when the reception unit receives the second signal and the fourth signal.

8. The method for inspecting a lock set in accordance with claim 1, wherein the reception unit determines the door is opened and the latch is locked when the reception unit receives the first signal and the fourth signal.

9. The method for inspecting a lock set in accordance with claim 4, wherein the warning unit is selected from monitor, warning light, speaker or buzzer.

10. The method for inspecting a lock set in accordance with claim 1, wherein the first electronic switch and the second electronic switch are selected from micro switch or sensor.

* * * * *